US010081059B2

(12) United States Patent
Ziebarth et al.

(10) Patent No.: US 10,081,059 B2
(45) **Date of Patent: *Sep. 25, 2018**

(54) SILVER NANOWIRE MANUFACTURING METHOD

(71) Applicant: Dow Global Technologies LLC, Midland, MI (US)

(72) Inventors: Robin P. Ziebarth, Midland, MI (US); Richard A. Patyk, Frankenmuth, MI (US); Wei Wang, Midland, MI (US); Patrick T. McGough, Midland, MI (US); George L. Athens, Freeland, MI (US); Janet M. Goss, Saginaw, MI (US); Jonathan D. Lunn, Pearland, TX (US)

(73) Assignee: Dow Global Technologies LLC, Midland, MI (US)

( * ) Notice: Subject to any disclaimer, the term of this patent is extended or adjusted under 35 U.S.C. 154(b) by 442 days.

This patent is subject to a terminal disclaimer.

(21) Appl. No.: 14/881,924

(22) Filed: Oct. 13, 2015

(65) Prior Publication Data

US 2016/0114397 A1 Apr. 28, 2016

Related U.S. Application Data

(60) Provisional application No. 62/069,440, filed on Oct. 28, 2014.

(51) Int. Cl.

| | |
|---|---|
| ***B22F 9/24*** | (2006.01) |
| ***B22F 1/00*** | (2006.01) |
| ***C22B 3/00*** | (2006.01) |
| ***H01B 1/02*** | (2006.01) |

(52) U.S. Cl.

CPC ..... *B22F 9/24* (2013.01); *B22F 1/004* (2013.01); *B22F 1/0044* (2013.01); *C22B 11/04* (2013.01); *H01B 1/02* (2013.01)

(58) Field of Classification Search

None

See application file for complete search history.

(56) References Cited

U.S. PATENT DOCUMENTS

| | | | | |
|---|---|---|---|---|
| 7,585,349 | B2 | 9/2009 | Xia et al. | |
| 7,749,299 | B2 | 7/2010 | Vanheusden et al. | |
| 7,922,787 | B2 | 4/2011 | Wang et al. | |
| 8,727,112 | B2 | 5/2014 | Young et al. | |
| 8,876,937 | B2 | 11/2014 | Peng et al. | |
| 2008/0032047 | A1 | 2/2008 | Parashar et al. | |
| 2008/0210052 | A1* | 9/2008 | Allemand | B22F 9/24 75/300 |
| 2009/0242231 | A1 | 10/2009 | Miyagishima et al. | |
| 2009/0311530 | A1 | 12/2009 | Hirai et al. | |
| 2010/0078197 | A1 | 4/2010 | Miyagishima et al. | |
| 2010/0242679 | A1 | 9/2010 | Yu et al. | |
| 2011/0162870 | A1* | 7/2011 | Markovich | C23C 18/14 174/126.1 |
| 2013/0087363 | A1* | 4/2013 | Oh | H01L 31/022466 174/126.1 |
| 2013/0152737 | A1* | 6/2013 | Chen | B22F 9/18 75/370 |
| 2013/0230737 | A1* | 9/2013 | Whitcomb | B22F 1/0025 428/606 |
| 2013/0255444 | A1 | 10/2013 | Kawaguchi | |
| 2013/0283974 | A1 | 10/2013 | Lunn et al. | |
| 2013/0334075 | A1 | 12/2013 | Young et al. | |
| 2014/0231282 | A1 | 8/2014 | Young et al. | |

FOREIGN PATENT DOCUMENTS

| | | |
|---|---|---|
| TW | 201024002 | 7/2010 |
| WO | 2003032084 | 4/2003 |

OTHER PUBLICATIONS

Korte, et al., Rapid synthesis of silver nanowires through a CuCl- or CuCl2-mediated polyol process, Journal of Materials Chemistry 18, pp. 437-441, (2007).

He et al., Synthesis and characterization of silver nanowires with zigzag morphology in N,N dimethylformamide, Journal of Solid State Chemistry 180, pp. 2262-2267 (2007).

Zhao, et al., Synthesis and formation mechanism of silver nanowires by a templateless and seedless method, Chemistry Letters, vol. 34, No. 1, pp. 30-31 (2005).

Tang, et al., One-dimensional assemblies of nanoparticles: preparation, properties, and promise, Acvanced Materials 17, No. 8, pp. 951-962 (2005).

Xiong, et al., Formation of silver nanowires through a sandwiched reduction process, Acvanced Materials 15, No. 5, pp. 405-408 (2003).

Sarkar, et al., Effective chemical route for the synthesis of silver nanostructures in formamide, Res. Chem. Intermed 35, pp. 71-78 (2009).

Mdluli, et al., An improved N,N-dimethylformamide and polyvinyl pyrrolidone approach for the synthesis of long silver nanowires, Journal of Alloys and Compounds 469, No. 5, pp. 519-522 (2009).

Walther, et al., Structure-tunable bidirectional hybrid nanowires via multicompartment cylinders, Nano Letters vol. 9, No. 5, pp. 2026-2030 (2009).

Pastoriza-Santos, et al., N,N-Dimethylformamide as a reaction medium for metal nanoparticle synthesis, Advanced Functional Material 19, pp. 679-688 (2009).

Sun, et al., Polyol synthesis of uniform silver nanowires: a plausible growth mechanism and the supporting evidence, Nano Letters, vol. 3, No. 7, pp. 955-960 (2003).

Wiley, et al., Polyol synthesis of silver nanostructures: control of product morphology with Fe(II) or Fe(III) species, Langmuir, vol. 21, No. 18, pp. 8077-8080 (2005).

Ducamp-Sanguese, et al., Synthesis and characterization of fine monodisperse silver particles of uniform shape 100, pp. 272-280 (1992).

Wiley, et al., Synthesis of silver nanostructures with controlled shapes and properties, Accounts of Chemical Research, vol. 40, pp. 1067-1076, (2007).

(Continued)

*Primary Examiner* — George Wyszomierski

(74) *Attorney, Agent, or Firm* — Thomas S. Deibert

(57) ABSTRACT

A process for manufacturing silver nanowires is provided, wherein the recovered silver nanowires have a high aspect ratio; and, wherein the total glycol concentration is <0.001 wt % at all times during the process.

10 Claims, No Drawings

(56) References Cited

OTHER PUBLICATIONS

Giersig, et al., Evidence of an aggregate mechanism during the formation of silver nanowires in N,N-dimethylformamide, J. Mater. Chem. 14, pp. 607-610 (2004).
Zhao, et al., Low temperature synthesis and growth mechanism of silver nanowires by a soft-chemistry method, Acta Chimica Sinica, vol. 61, No. 10, pp. 1671-1674 (2003).
Pallavicine, et al., Self-assembled monolayers of silver nanoparticles firmly grafted on glass surfaces: low Ag+ release for an efficient antibacterial activity, J. of Colloid and Interface Science 350, pp. 110-116 (2010).
Pastoriza-Santos, et al., Formation and Stabilization of Silver Nanoparticles through Reduction by N,N-Dimethylformamide, Langmuir 15, pp. 948-951 (1999).
Copending U.S. Appl. No. 14/881,859.
Copending U.S. Appl. No. 14/881,890.
Copending U.S. Appl. No. 14/881,955.

* cited by examiner

SILVER NANOWIRE MANUFACTURING METHOD

This application claims priority to U.S. Provisional Application No. 62/069,440 filed on Oct. 28, 2014.

The present invention relates generally to the field of manufacture of silver nanowires. In particular, the present invention is directed to a method for manufacturing silver nanowires exhibiting a high aspect ratio for use in various applications.

Films that exhibit a high conductivity with a high transparency are of great value for use as electrodes or coatings in a wide range of electronic applications, including, for example, touch screen displays and photovoltaic cells. Current technology for these applications involves the use of a tin doped indium oxide (ITO) containing films that are deposited through physical vapor deposition methods. The high capital cost of physical vapor deposition processes has led to the desire to find alternative transparent conductive materials and coating approaches. The use of silver nanowires dispersed as a percolating network has emerged as a promising alternative to ITO containing films. The use of silver nanowires potentially offer the advantage of being processable using roll to roll techniques. Hence, silver nanowires offer the advantage of low cost manufacturing with the potential of providing higher transparency and conductivity than conventional ITO containing films.

The "polyol process" has been disclosed for the manufacture of silver nanostructures. The polyol process uses ethylene glycol (or an alternative glycol) as both a solvent and a reducing agent in the production of silver nanowires. The use of glycols; however, has several inherent disadvantages. Specifically, using glycol as both the reducing agent and the solvent results in a decrease in control over the reaction as the principal reducing agent species (glycolaldehyde) is produced in situ and its presence and concentration are dependent on the extent of exposure to oxygen. Also, the use of glycol introduces the potential for the formation of combustible glycol/air mixtures in the headspace of the reactor used to produce the silver nanowires. Finally, the use of large volumes of glycol create disposal concerns, increasing the cost of commercializing such operations.

One alternative approach to the polyol process for manufacturing silver nanowires has been disclosed by Miyagishima, et al. in United States Patent Application Publication No. 20100078197. Miyagishima, et al. disclose a method for producing metal nanowires, comprising: adding a solution of a metal complex to a water solvent containing at least a halide and a reducing agent, and heating a resultant mixture at 150° C. or lower, wherein the metal nanowires comprise metal nanowires having a diameter of 50 nm or less and a major axis length of 5 μm or more in an amount of 50% by mass or more in terms of metal amount with respect to total metal particles.

Another alternative approach to the polyol process for manufacturing silver nanowires has been disclosed by Lunn, et al. in United States Patent Application Publication No. 20130283974. Lunn, et al. disclose a process for manufacturing high aspect ratio silver nanowires, wherein the recovered silver nanowires exhibit an average diameter of 25 to 80 nm and an average length of 10 to 100 μm; and, wherein the total glycol concentration is <0.001 wt % at all times during the process.

Notwithstanding, while producing desirable, high aspect ratio silver nanowires, the manufacturing method described by Lunn, et al. also results in the formation of silver nanowire populations having a broad diameter distribution which can result in non-uniformity in the electrical properties of films produced therewith.

Accordingly, there remains a need for alternative silver nanowire manufacturing methods. In particular, for methods of manufacturing silver nanowires that do not involve the use of glycol, wherein the silver nanowires produced exhibit a high aspect ratio (preferably >500) in combination with a narrow silver nanowire diameter distribution.

The present invention provides a method for manufacturing high aspect ratio silver nanowires, comprising: providing a container; providing water; providing a reducing sugar; providing a reducing agent; providing a polyvinyl pyrrolidone (PVP), wherein the polyvinyl pyrrolidone (PVP) provided is divided into a first part of the polyvinyl pyrrolidone (PVP) and a second part of the polyvinyl pyrrolidone (PVP); providing a source of copper (II) ions; providing a source of halide ions; providing a source of silver ions, wherein the source of silver ions provided is divided into a first portion of the source of silver ions and a second portion of the source of silver ions; adding the water, the reducing sugar, the source of copper (II) ions and the source of halide ions to the container to form a combination; heating the combination to 110 to 160° C.; adding the first part of the polyvinyl pyrrolidone (PVP), the first portion of the source of silver ions and the reducing agent to the combination in the container to form a creation mixture; then adding to the container the second part of the polyvinyl pyrrolidone (PVP) and the second portion of the source of silver ions to form a growth mixture; maintaining the growth mixture at 110 to 160° C. for a hold period of 2 to 30 hours to provide a product mixture; and, recovering a plurality of high aspect ratio silver nanowires from the product mixture; wherein a total glycol concentration in the container is <0.001 wt % at all times.

The present invention provides a method for manufacturing high aspect ratio silver nanowires, comprising: providing a container; providing water; providing a reducing sugar; providing a reducing agent, wherein the reducing agent is selected from the group consisting of ascorbic acid, sodium borohydride ($NaBH_4$), hydrazine, salts of hydrazine, hydroquinone, $C_{1-5}$ alkyl aldehyde and benzaldehyde; providing a polyvinyl pyrrolidone (PVP), wherein the polyvinyl pyrrolidone (PVP) provided is divided into a first part of the polyvinyl pyrrolidone (PVP) and a second part of the polyvinyl pyrrolidone (PVP); providing a source of copper (II) ions; providing a source of halide ions; providing a source of silver ions, wherein the source of silver ions provided is divided into a first portion of the source of silver ions and a second portion of the source of silver ions; adding the water, the reducing sugar, the source of copper (II) ions and the source of halide ions to the container to form a combination; heating the combination to 110 to 160° C.; adding the first part of the polyvinyl pyrrolidone (PVP), the first portion of the source of silver ions and the reducing agent to the combination in the container to form a creation mixture; then adding to the container the second part of the polyvinyl pyrrolidone (PVP) and the second portion of the source of silver ions to form a growth mixture; maintaining the growth mixture at 110 to 160° C. for a hold period of 2 to 30 hours to provide a product mixture; and, recovering a plurality of high aspect ratio silver nanowires from the product mixture; wherein a total glycol concentration in the container is <0.001 wt % at all times.

The present invention provides a method for manufacturing high aspect ratio silver nanowires, comprising: providing a container; providing water; providing a reducing sugar;

providing a reducing agent; providing a polyvinyl pyrrolidone (PVP), wherein the polyvinyl pyrrolidone (PVP) provided is divided into a first part of the polyvinyl pyrrolidone (PVP) and a second part of the polyvinyl pyrrolidone (PVP); providing a source of copper (II) ions; providing a source of halide ions; providing a source of silver ions, wherein the source of silver ions provided is divided into a first portion of the source of silver ions and a second portion of the source of silver ions; providing a pH adjusting agent; adding the water, the reducing sugar, the source of copper (II) ions, the source of halide ions and the pH adjusting agent to the container to form a combination; wherein the combination has a pH of 2.0 to 4.0; heating the combination to 110 to 160° C.; adding the first part of the polyvinyl pyrrolidone (PVP), the first portion of the source of silver ions and the reducing agent to the combination in the container to form a creation mixture; then adding to the container the second part of the polyvinyl pyrrolidone (PVP) and the second portion of the source of silver ions to form a growth mixture; maintaining the growth mixture at 110 to 160° C. for a hold period of 2 to 30 hours to provide a product mixture; and, recovering a plurality of high aspect ratio silver nanowires from the product mixture; wherein a total glycol concentration in the container is <0.001 wt % at all times.

DETAILED DESCRIPTION

A method for manufacturing high aspect ratio silver nanowires has been found which surprisingly provides silver nanowires having an average diameter of 20 to 60 nm and an average length of 20 to 100 μm, while avoiding the inherent disadvantages associated with the use of glycols and while providing silver nanowires having a high degree of diameter uniformity. Silver nanowire populations exhibiting a narrow diameter distribution such as those provided by the method of the present invention provide advantage in the preparation of films having more uniform conductive properties and transparency across the film.

The term "total glycol concentration" as used herein and in the appended claims in reference to the container contents means combined total of the concentration of all glycols (e.g., ethylene glycol, propylene glycol, butylene glycol, poly(ethylene glycol), poly(propylene glycol)) present in the container.

The term "high aspect ratio" as used herein and in the appended claims in reference to the recovered silver nanowires means that the average aspect ratio of the recovered silver nanowires is >500.

The term "silver nanoparticle fraction" or "$NP_F$" used herein and in the appended claims is the silver nanowire fraction of a sample of silver nanowires determined according to the following equation:

$$NP_F = NP_A / T_A$$

wherein $T_A$ is the total surface area of a substrate that is occluded by a given deposited sample of silver nanowires; and, $NP_A$ is the portion of the total occluded surface area that is attributable to silver nanoparticles having an aspect ratio of <3 included in the deposited sample of silver nanowires.

Preferably, the process for manufacturing high aspect ratio silver nanowires of the present invention, comprises: providing a container; providing water; providing a reducing sugar; providing a reducing agent; providing a polyvinyl pyrrolidone (PVP), wherein the polyvinyl pyrrolidone (PVP) provided is divided into a first part of the polyvinyl pyrrolidone (PVP) and a second part of the polyvinyl pyrrolidone; providing a source of copper (II) ions; providing a source of halide ions; providing a source of silver ions, wherein the source of silver ions provided is divided into a first portion of the source of silver ions and a second portion of the source of silver ions; adding the water, the reducing sugar, the source of copper (II) ions and the source of halide ions to the container to form a combination; heating the combination to 110 to 160° C. (preferably, 120 to 150° C.; more preferably, 125 to 140° C.; most preferably, 130° C.); adding (preferably with agitation) the first part of the polyvinyl pyrrolidone (PVP), the first portion of the source of silver ions and the reducing agent to the combination in the container to form a creation mixture; then (preferably, following a delay period) adding to the creation mixture the second part of the polyvinyl pyrrolidone (PVP) and the second portion of the source of silver ions to form a growth mixture; maintaining the growth mixture at a temperature of 110 to 160° C. (preferably, 120 to 150° C.; more preferably, 125 to 135° C.; most preferably, 130° C.) for a hold period of 2 to 30 hours (preferably, 4 to 20 hours; more preferably 6 to 15 hours) to provide a product mixture; and, recovering a plurality of high aspect ratio silver nanowires from the product mixture; wherein a total glycol concentration in the container is <0.001 wt % at all times during the process. Preferably, wherein a weight ratio of polyvinyl pyrrolidone (PVP) to silver ions added to the container is 4:1 to 10:1; and, wherein a weight ratio of halide ions to copper (II) ions added to the container is 1:1 to 5:1. Preferably, wherein the plurality of high aspect ratio silver nanowires recovered have an average diameter of ≤40 nm (preferably, 20 to 40 nm; more preferably, 20 to 35 nm; most preferably, 20 to 30 nm) and an average length of 10 to 100 μm. Preferably, wherein the plurality of high aspect ratio silver nanowires recovered have an average aspect ratio >500.

Preferably, the water provided in the process for manufacturing high aspect ratio silver nanowires of the present invention is at least one of deionized and distilled to limit incidental impurities. More preferably, the water provided in the process for manufacturing high aspect ratio silver nanowires of the present invention is deionized and distilled. Most preferably, the water provided in the process for manufacturing high aspect ratio silver nanowires of the present invention is ultrapure water that meets or exceeds the Type 1 water requirements according to ASTM D1193-99e1 (Standard Specification for Reagent Water).

Preferably, the reducing sugar provided in the process for manufacturing high aspect ratio silver nanowires of the present invention is selected from the group consisting of at least one of aldoses (e.g., glucose, glyceraldehyde, galactose, mannose); disaccharides with a free hemiacetal unit (e.g., lactose and maltose); and ketone bearing sugars (e.g., fructose). More preferably, the reducing sugar provided in the process for manufacturing high aspect ratio silver nanowires of the present invention is selected from the group consisting of at least one of an aldose, lactose, maltose and fructose. Still more preferably, the reducing sugar provided in the process for manufacturing high aspect ratio silver nanowires of the present invention is selected from the group consisting of at least one of glucose, glyceraldehyde, galactose, mannose, lactose, fructose and maltose. Most preferably, the reducing sugar provided in the process for manufacturing high aspect ratio silver nanowires of the present invention is D-glucose.

Preferably, the polyvinyl pyrrolidone (PVP) provided in the process for manufacturing high aspect ratio silver nanowires of the present invention has a weight average molecular weight, $M_W$, of 20,000 to 300,000 Daltons. More preferably, the polyvinyl pyrrolidone (PVP) provided in the process for manufacturing high aspect ratio silver nanowires of the present invention has a weight average molecular weight, $M_W$, of 30,000 to 200,000 Daltons. Most preferably, the polyvinyl pyrrolidone (PVP) provided in the process for manufacturing high aspect ratio silver nanowires of the present invention has a weight average molecular weight, $M_W$, of 40,000 to 60,000 Daltons.

Preferably, the polyvinyl pyrrolidone (PVP) provided is divided into a first part of the polyvinyl pyrrolidone (PVP) and a second part of the polyvinyl pyrrolidone (PVP). Preferably, the first part of the polyvinyl pyrrolidone (PVP) is 10 to 40 wt % (more preferably, 10 to 30 wt %; most preferably, 15 to 25 wt %) of the polyvinyl pyrrolidone (PVP) provided.

Preferably, the source of copper (II) ions provided in the process for manufacturing high aspect ratio silver nanowires of the present invention is selected from the group consisting of at least one of $CuCl_2$ and $Cu(NO_3)_2$. More preferably, the source of copper (II) ions provided in the process for manufacturing high aspect ratio silver nanowires of the present invention is selected from the group consisting of $CuCl_2$ and $Cu(NO_3)_2$. Most preferably, the source of copper (II) ions provided in the process for manufacturing high aspect ratio silver nanowires of the present invention is $CuCl_2$, wherein the $CuCl_2$ is a copper (II) chloride dihydrate.

Preferably, the source of halide ions provided in the process for manufacturing high aspect ratio silver nanowires of the present invention is selected from the group consisting of at least one of a source of chloride ions, a source of fluoride ions, a source of bromide ions and a source of iodide ions. More preferably, the source of halide ions provided in the process for manufacturing high aspect ratio silver nanowires of the present invention is selected from the group consisting of at least one of a source of chloride ions and a source of fluoride ions. Still more preferably, the source of halide ions provided in the process for manufacturing high aspect ratio silver nanowires of the present invention is a source of chloride ions. Most preferably, the source of halide ions provided in the process for manufacturing high aspect ratio silver nanowires of the present invention is a source of chloride ions, wherein the source of chloride ions is an alkali metal chloride. Preferably, the alkali metal chloride is selected from the group consisting of at least one of sodium chloride, potassium chloride and lithium chloride. More preferably, the alkali metal chloride is selected from the group consisting of at least one of sodium chloride and potassium chloride. Most preferably, the alkali metal chloride is sodium chloride.

Preferably, the source of silver ions provided in the process for manufacturing high aspect ratio silver nanowires of the present invention is a silver complex. More Preferably, the source of silver ions provided in the process for manufacturing high aspect ratio silver nanowires of the present invention is a silver complex; wherein the silver complex is selected from the group consisting of at least one of silver nitrate ($AgNO_3$) and silver acetate ($AgC_2H_3O_2$). Most preferably, the source of silver ions provided in the process for manufacturing high aspect ratio silver nanowires of the present invention is silver nitrate ($AgNO_3$). Preferably, the source of silver ions provided in the method for manufacturing high aspect ratio silver nanowires of the present invention has a silver concentration of 0.005 to 1 molar (M) (more preferably, of 0.01 to 1 M; most preferably, of 0.4 to 1 M).

Preferably, the source of silver ions provided is divided into a first portion of the source of silver ions and a second portion. Preferably, the first portion of the source of silver ions is 10 to 40 wt % (more preferably, 10 to 30 wt %; most preferably, 15 to 25 wt %) of the source of silver ions provided.

Preferably, the reducing agent provided in the method for manufacturing high aspect ratio silver nanowires of the present invention is selected from the group consisting of ascorbic acid; borohydride salts (e.g., $NaBH_4$, $KBH_4$, $LiBH_4$, $Ca(BH_4)_2$); hydrazine; salts of hydrazine; hydroquinone; $C_{1-5}$ alkyl aldehyde and benzaldehyde. More preferably, the reducing agent provided in the method for manufacturing high aspect ratio silver nanowires of the present invention is selected from the group consisting of ascorbic acid, sodium borohydride ($NaBH_4$), potassium borohydride ($KBH_4$), lithium borohydride ($LiBH_4$), calcium borohydride ($Ca(BH_4)_2$), hydrazine, salts of hydrazine, hydroquinone, acetaldehyde, propionaldehyde and benzaldehyde. Most preferably, the reducing agent provided in the method for manufacturing high aspect ratio silver nanowires of the present invention is at least one of ascorbic acid and sodium borohydride.

Preferably, in the process for manufacturing high aspect ratio silver nanowires of the present invention, the water, the reducing sugar, the source of copper (II) ions, the source of halide ions and the pH adjusting agent, if any, are added to a container (preferably, wherein the container is a reactor; more preferably, wherein the container is a reactor outfitted with an agitator) to form a combination; and then, the source of silver ions are added to the combination in the container (preferably, with agitation) to form a growth mixture while maintaining the combination at a temperature of 110 to 160° C. (preferably, 120 to 150° C.; more preferably, 125 to 135° C.; most preferably, 130° C.) during addition of the source of silver ions and after addition of the source of silver ions for a hold period of 2 to 30 hours (preferably, 4 to 20 hours; more preferably 6 to 15 hours) to provide the product mixture.

Preferably, the water, the reducing sugar, the source of copper (II) ions, the source of halide ions and the pH adjusting agent, if any, are added to the container in any order in individual sequence (i.e., one at a time), simultaneously (i.e., all at the same time), or semi-simultaneously (i.e., some individually one at a time, some simultaneously at the same time or as subcombinations) to form a combination. More preferably, at least two of the water, the reducing sugar, the source of copper (II) ions, the source of halide ions and the pH adjusting agent, if any, are mixed together to form a subcombination before addition to the container to form the combination.

Preferably, the method for manufacturing high aspect ratio silver nanowires of the present invention, further comprises: a delay period, wherein the delay period is interposed between adding the first portion of the source of silver ions to form the creation mixture and adding the second portion of the source of silver ions to form the growth mixture. Preferably, the delay period between the additions is 5 seconds to 60 minutes (more preferably, 1 to 20 minutes; most preferably 5 to 15 minutes). Preferably, the method of the present invention: the source of silver ions provided is divided into a first portion of the source of silver ions and a second portion of the source of silver ions, wherein the first portion of the source of silver ions is 10 to 30 wt % of the source of silver ions provided (preferably, wherein the first portion of the source of silver ions is 15 to 25 wt % of the source of silver ions provided; more preferably, wherein the first portion of the source of silver ions is 20 wt % of the source of silver ions provided).

The method for manufacturing high aspect ratio silver nanowires of the present invention preferably further comprises: providing a pH adjusting agent; and, adding the pH adjusting agent to the container. The pH adjusting agent can be added to the container along with the water, the reducing sugar, the source of copper (II) ions and the source of halide ions as part of the combination; wherein the combination has a pH of 2.0 to 4.0 (preferably, 2.0 to 3.5; more preferably, 2.4 to 3.3; most preferably, 2.4 to 2.6). The pH adjusting agent can be added to the container simultaneously with the polyvinyl pyrrolidone (PVP). Preferably, when the pH adjusting agent is added simultaneously with the polyvinyl pyrrolidone (PVP), the pH adjusting agent is added to the polyvinyl pyrrolidone (PVP) before addition to the container; wherein the polyvinyl pyrrolidone (PVP) has a pH of 2.0 to 4.0 (preferably, 2.0 to 3.5; more preferably, 2.3 to 3.3; most preferably, 3.1 to 3.3). Preferably, the pH adjusting agent is added to the polyvinyl pyrrolidone (PVP) provided before dividing the polyvinyl pyrrolidone (PVP) provided into a first part of the polyvinyl pyrrolidone (PVP) and a second part of the polyvinyl pyrrolidone (PVP), wherein the polyvinyl pyrrolidone (PVP) provided has a pH of 2.0 to 4.0 (preferably, 2.0 to 3.5; more preferably, 2.3 to 3.3; most preferably, 3.1 to 3.3).

Preferably, the pH adjusting agent provided in the method for manufacturing high aspect ratio silver nanowires of the present invention is an acid. More preferably, the pH adjusting agent provided in the method for manufacturing high aspect ratio silver nanowires of the present invention is an acid, wherein the acid is selected from the group consisting of at least one of inorganic acids (e.g., nitric acid, sulfuric acid, hydrochloric acid, fluorosulfuric acid, phosphoric acid, fluoroantimonic acid) and organic acids (e.g., methane sulfonic acid, ethane sulfonic acid, benzene sulfonic acid, acetic acid, fluoroacetic acid, chloroacetic acid, citric acid, gluconic acid, lactic acid). Preferably, the pH adjusted agent provided in the method for manufacturing high aspect ratio silver nanowires of the present invention has a pH of <2.0. Still more preferably, the pH adjusting agent provided in the method for manufacturing high aspect ratio silver nanowires of the present invention includes nitric acid. Most preferably, the pH adjusting agent provided in the method for manufacturing high aspect ratio silver nanowires of the present invention is aqueous nitric acid.

Preferably, the method for manufacturing high aspect ratio silver nanowires of the present invention, further comprises: purging a container vapor space in contact with the combination in the container to provide a reduced oxygen gas concentration in the container vapor space. Preferably, the step of purging the container vapor space in contact with the combination in the container to provide the reduced oxygen gas concentration in the container vapor space, includes: (i) isolating the container vapor space from a surrounding atmosphere outside the container; (ii) then pressuring the container vapor space with an inert gas (preferably, wherein the inert gas is selected from the group consisting of argon, helium, methane, and nitrogen (more preferably, argon, helium and nitrogen; still more preferably, argon and nitrogen; most preferably, nitrogen)); and, (iii) then purging the container vapor space to provide the reduced oxygen gas concentration in the container vapor space. Preferably, the container vapor space is purged down to a container pressure that is > an atmospheric pressure of the surrounding atmosphere) to provide the reduced oxygen gas concentration in the container vapor space. Preferably, the reduced oxygen gas concentration is ≤2,000 ppm (more preferably, ≤400 ppm; most preferably; ≤20 ppm)). More preferably, the step of purging the container vapor space in contact with the combination in the container to provide the reduced oxygen gas concentration in the container vapor space, includes: (i) isolating the container vapor space from a surrounding atmosphere outside the container; (ii) then pressuring the container vapor space with an inert gas (preferably, wherein the inert gas is selected from the group consisting of argon, helium, methane, and nitrogen (more preferably, argon, helium and nitrogen; still more preferably, argon and nitrogen; most preferably, nitrogen)); and, (iii) then purging the container vapor space to provide the reduced oxygen gas concentration in the container vapor space (preferably, wherein the container vapor space is purged down to a container pressure that is > an atmospheric pressure of the surrounding atmosphere outside the container); and, (iv) repeating steps (ii) and (iii) at least three times to provide the reduced oxygen gas concentration in the container vapor space (preferably, wherein the reduced oxygen gas concentration is ≤2,000 ppm (more preferably, ≤400 ppm; most preferably; ≤20 ppm)). Preferably, the method for manufacturing high aspect ratio silver nanowires of the present invention, further comprises: maintaining the reduced oxygen gas concentration in the container vapor space during formation of the creation mixture, during formation of the growth mixture and during the hold period.

Preferably, the method for manufacturing high aspect ratio silver nanowires of the present invention, further comprises: sparging the source of silver ions provided with an inert gas to extract entrained oxygen gas from the source of silver ions and to provide a low oxygen gas concentration in a silver ion vapor space in contact with the source of silver ions. Preferably, the step of sparging the source of silver ions provided with an inert gas comprises (preferably, consists of): sparging the source of silver ions provided with an inert gas (preferably, wherein the inert gas is selected from the group consisting of argon, helium, methane, and nitrogen (more preferably, argon, helium and nitrogen; still more preferably, argon and nitrogen; most preferably, nitrogen)) for a sparging time of ≥5 minutes (more preferably, 5 minutes to 2 hours; most preferably, 5 minutes to 1.5 hours) before addition to the container to extract entrained oxygen gas from the source of silver ions provided and to provide a low oxygen gas concentration in the silver ion vapor space. Preferably, the low oxygen gas concentration in the silver ion vapor space is ≤10,000 ppm (preferably; ≤1,000 ppm; more preferably, ≤400 ppm; most preferably; ≤20 ppm). Preferably, the method for manufacturing high aspect ratio silver nanowires of the present invention, further comprises: maintaining the low oxygen gas concentration in the silver ion vapor space until the source of silver ions provided is added to the container.

Preferably, the method for manufacturing high aspect ratio silver nanowires of the present invention, further comprises: purging a PVP vapor space in contact with the polyvinyl pyrrolidone (PVP) provided to provide a diluted oxygen gas concentration in the PVP vapor space. Preferably, the step of purging the PVP vapor space to provide the diluted oxygen gas concentration in the PVP vapor space, includes: (i) isolating the polyvinyl pyrrolidone (PVP) provided; (ii) then pressuring the PVP vapor space with an inert gas (preferably, wherein the inert gas is selected from the group consisting of argon, helium, methane, and nitrogen (more preferably, argon, helium and nitrogen; still more preferably, argon and nitrogen; most preferably, nitrogen)); and, (iii) then purging the PVP vapor space to provide the diluted oxygen gas concentration in the PVP vapor space. Preferably, the PVP vapor space is purged down to a pressure that is > an atmospheric pressure of the surrounding atmosphere to provide the diluted oxygen gas concentration in the PVP vapor space. More preferably, the step of purging the PVP vapor space to provide the diluted oxygen gas concentration in the PVP vapor space, includes: (i) isolating the polyvinyl pyrrolidone (PVP) provided; (ii) then pressuring the PVP vapor space with an inert gas (preferably, wherein the inert gas is selected from the group consisting of argon, helium, methane, and nitrogen (more preferably, argon, helium and nitrogen; still more preferably, argon and nitrogen; most preferably, nitrogen)); (iii) then purging the PVP vapor space to provide the diluted oxygen gas concentration in the PVP vapor space (preferably, wherein the PVP vapor space is purged down to an inert gas pressure that is > an atmospheric pressure); and, (iv) repeating steps (ii) and (iii) at least three times to provide the diluted oxygen gas concentration in the PVP vapor space. Preferably, the diluted oxygen gas concentration in the PVP vapor space is ≤10,000 ppm (preferably; ≤1,000 ppm; more preferably, ≤400 ppm; most preferably; ≤20 ppm). Preferably, the method for manufacturing high aspect ratio silver nanowires of the present invention, further comprises: maintaining the diluted oxygen gas concentration in the PVP vapor space until the polyvinyl pyrrolidone (PVP) provided is added to the container.

Preferably, the method for manufacturing high aspect ratio silver nanowires of the present invention, further comprises: purging a container vapor space in contact with the combination in the container to provide a reduced oxygen gas concentration in the container vapor space; sparging the source of silver ions provided with an inert gas to extract entrained oxygen gas from the source of silver ions provided and to provide a low oxygen gas concentration in a silver ion vapor space in contact with the source of silver ions provided; purging a PVP vapor space in contact with the polyvinyl pyrrolidone (PVP) provided to provide a diluted oxygen gas concentration in the PVP vapor space; maintaining the low oxygen gas concentration in the silver ion vapor space and the diluted oxygen gas concentration in the PVP vapor space; and, maintaining the reduced oxygen gas concentration in the container vapor space during formation of the creation mixture, during formation of the growth mixture and during the hold period.

Preferably, in the process for manufacturing high aspect ratio silver nanowires of the present invention, the polyvinyl pyrrolidone (PVP) provided and some of the water are provided as a polyvinyl pyrrolidone (PVP) subcombination. Preferably, the polyvinyl pyrrolidone (PVP) provided is divided into a first part of the polyvinyl pyrrolidone (PVP) and a second part of the polyvinyl pyrrolidone (PVP) following the formation of a polyvinyl pyrrolidone (PVP) subcombination with water. Preferably, the first part of the polyvinyl pyrrolidone (PVP) and the second part of the polyvinyl pyrrolidone (PVP) are separately added to the container simultaneously with the first portion of the source of silver ions and the second portion of the source of silver ions, respectively. When the polyvinyl pyrrolidone (PVP) and the source of silver ions are added to the container simultaneously, but separately (i.e., through separate entry points); at least one of the polyvinyl pyrrolidone (PVP) and the source of silver ions are added at a point below a surface of the combination in the container (preferably, wherein the first portion of the source of silver ions and the second portion of the source of silver ions are introduced into the container at a point below the surface of the combination in the container; and, wherein the first part of the polyvinyl pyrrolidone (PVP) and the second part of the polyvinyl pyrrolidone (PVP) are introduced into the container at a point above the surface of the combination in the container).

Preferably, the water is divided into at least two volumes of water (more preferably, at least three volumes of water; most preferably, at least four volumes of water) to facilitate the formation of at least two subcombinations that include water before addition to the container. More preferably, the water is divided into at least five volumes of water, wherein a first volume of water is combined with the reducing sugar to form a reducing sugar subcombination, wherein a second volume of water is combined with the source of copper (II) ions to form a copper (II) ion subcombination, wherein a third volume of water is combined with the source of halide ions to form a halide ion subcombination, wherein a forth volume of water is combined with the polyvinyl pyrrolidone (PVP) provided to form a polyvinyl pyrrolidone (PVP) subcombination, wherein a fifth volume of water is combined with the source of silver ions to form a silver ion subcombination. Preferably, the reducing sugar subcombination, the copper (II) ion subcombination, the halide ion subcombination and the pH adjusting agent, if any, are added to the container in any order in individual sequence (i.e., one at a time), simultaneously (i.e., all at the same time), or semi-simultaneously (i.e., some individually one at a time, some simultaneously at the same time or as further subcombinations) to form the combination. More preferably, the reducing sugar subcombination is added to the container, followed by the addition to the container of the copper (II) ion subcombination, the halide ion subcombination and the pH adjusting agent, if any, in any order in individual sequence (i.e., one at a time), simultaneously (i.e., all at the same time), or semi-simultaneously (i.e., some individually one at a time, some simultaneously at the same time or as further subcombinations) to form the combination. Most preferably, the reducing sugar subcombination is added to the container, followed by the addition of the copper (II) ion subcombination to the container, followed by the addition of the halide ion subcombination to the container, followed by the addition of the pH adjusting agent, if any, to form the combination. The polyvinyl pyrrolidone (PVP) subcombination; the silver ion subcombination and the reducing agent are then added to the combination in the container.

Preferably, in the process for manufacturing high aspect ratio silver nanowires of the present invention, the reducing agent and some of the water are provided as a reducing agent subcombination. Preferably, the reducing agent is added to the container following the addition of the first portion of the source of silver ions. More preferably, the reducing agent is added to the container following the addition of both the first portion of the source of silver ions and the first part of the polyvinyl pyrrolidone (PVP).

Preferably, in the process for manufacturing high aspect ratio silver nanowires of the present invention, a total glycol concentration in the container is <0.001 wt % at all times during the process.

Preferably, in the method for manufacturing high aspect ratio silver nanowires of the present invention, the polyvinyl pyrrolidone (PVP) and the source of silver ions are added to the container at a weight ratio of polyvinyl pyrrolidone (PVP) to silver ions of 4:1 to 10:1 (more preferably, 5:1 to 8:1; most preferably, 6:1 to 7:1).

Preferably, in the method for manufacturing high aspect ratio silver nanowires of the present invention, the source of halide ions and the source of copper (II) ions are added to the container at a weight ratio of halide ions to copper (II) ions of 1:1 to 5:1 (more preferably, 2:1 to 4:1; most preferably, 2.5:1 to 3.5:1).

Preferably, in the method for manufacturing high aspect ration silver nanowires of the present invention, the reducing agent is provided in sufficient quantity to convert 0.01 to 5.0 mol % (more preferably, 0.025 to 1 mol %; most preferably, 0.04 to 0.6 mol %) of the $AgNO_3$ to Ag metal.

Preferably, in the method for manufacturing high aspect ratio silver nanowires of the present invention, the recovered silver nanowires exhibit an average diameter of ≤40 nm (preferably, 20 to 40 nm; more preferably, 20 to 35 nm; most preferably, 20 to 30 nm). More preferably, in the method for manufacturing high aspect ratio silver nanowires of the present invention, the recovered silver nanowires exhibit an average diameter of ≤40 nm (preferably, 20 to 40 nm; more preferably, 20 to 35; most preferably, 20 to 30 nm) and an average length of 10 to 100 μm. Preferably, the recovered silver nanowires exhibit an average aspect ratio of >500.

Preferably, in the method for manufacturing high aspect ratio silver nanowires of the present invention, the recovered silver nanowires exhibit a diameter standard deviation of ≤35 nm (preferably, 1 to 32 nm; more preferably, 1 to 25 nm; most preferably, 5 to 20 nm). More preferably, in the method for manufacturing high aspect ratio silver nanowires of the present invention, the recovered silver nanowires exhibit an average diameter of ≤40 nm (preferably, 20 to 40 nm; more preferably, 20 to 35 nm; most preferably, 20 to 30 nm) with a diameter standard deviation of ≤35 nm (preferably, 1 to 32 nm; more preferably, 1 to 25 nm; most preferably, 5 to 20 nm). Most preferably, in the method for manufacturing high aspect ratio silver nanowires of the present invention, the recovered silver nanowires exhibit an average diameter of ≤40 nm (preferably, 20 to 40 nm; more preferably, 20 to 35 nm; most preferably, 20 to 30 nm) with a diameter standard deviation of ≤35 nm (preferably, 1 to 32 nm; more preferably, 1 to 25 nm; most preferably, 5 to 20 nm) and an average length of 10 to 100 μm.

Preferably, in the process for manufacturing high aspect ratio silver nanowires of the present invention, the plurality of high aspect ratio silver nanowires recovered from the product mixture have a silver nanoparticle fraction, $NP_F$, of <0.2 (preferably, <0.17; more preferably, <0.15; most preferably, <0.13) (as determined according the to method described herein in the Examples).

Some embodiments of the present invention will now be described in detail in the following Examples.

The water used in the following Examples was obtained using a ThermoScientific Barnstead NANOPure purification system with a 0.2 μm pore size hollow fiber filter positioned downstream of the water purification unit.

EXAMPLE S1

Halide Ion Subcombination

The halide ion subcombination used herein in certain Examples was prepared by dissolving sodium chloride (0.2104 g; available from Sigma Aldrich) in water (900 mL).

EXAMPLE S2

Copper (II) Ion Subcombination

The copper (II) ion subcombination used herein in certain Examples was prepared by dissolving copper (II) chloride dihydrate (0.6137 g; available from Sigma Aldrich) in water (900 mL).

EXAMPLE S3

Reducing Sugar/Polyvinyl Pyrrolidone (PVP) Subcombination

The reducing sugar/polyvinyl pyrrolidone (PVP) subcombination used herein in certain Examples was prepared by combining polyvinyl pyrrolidone (PVP) (5.14 g; Sokalan® K30 P available from BASF having a weight average molecular weight of 50,000 g/mol) and D-glucose (1.33 g; >99% from Sigma-Aldrich) in water (250 mL).

EXAMPLE S4

Combination

The combination used herein in certain Examples was prepared by combining a reducing sugar/polyvinyl pyrrolidone (PVP) subcombination prepared according to Example S3; a halide ion subcombination (2.1 mL) prepared according to Example S1; and, a copper (II) ion subcombination (2.1 mL) prepared according to Example S2.

EXAMPLE S5

Silver Ion Subcombination

The silver ion subcombination used herein in certain Examples was prepared by adding $AgNO_3$ (1.25 g; ACS reagent grade, ≥99.0% available from Sigma Aldrich) to water (30 mL).

EXAMPLE S6

Reducing Sugar Subcombination

The reducing sugar subcombination used herein in certain Examples was prepared by dissolving D-glucose (1.33 g; >99% from Sigma-Aldrich) in water (250 mL).

EXAMPLE S7

Polyvinyl Pyrrolidone (PVP) Subcombination

The polyvinyl pyrrolidone (PVP) subcombination used herein in certain Examples was prepared by adding polyvinyl pyrrolidone (PVP) (5.14 g; Sokalan® K30 P available from BASF having a weight average molecular weight of 50,000 g/mol) to water (25 mL).

EXAMPLE S8

Silver Ion Subcombination

The silver ion subcombination used herein in certain Examples was prepared by adding $AgNO_3$ (1.25 g; ACS reagent grade, ≥99.0% available from Sigma Aldrich) to water (25 mL).

EXAMPLE S9

Reducing Agent Subcombination

The reducing agent subcombination used herein in certain Examples was prepared by adding ascorbic acid (3.2 mg) to water (10 mL).

EXAMPLE S10

Reducing Agent Subcombination

The reducing agent subcombination used herein in certain Examples was prepared by adding ascorbic acid (6 mg) to water (20 mL).

EXAMPLE S11

Reducing Agent Subcombination

The reducing agent subcombination used herein in certain Examples was prepared by adding sodium borohydride ($NaBH_4$) (6 mg) to water (71 mL).

EXAMPLE S12

Reducing Agent Subcombination

The reducing agent subcombination used herein in certain Examples was prepared by adding sodium borohydride ($NaBH_4$) (12 mg) to water (70 mL).

EXAMPLE S13

Reducing Agent Subcombination

The reducing agent subcombination used herein in certain Examples was prepared by adding hydrazine dihydrochloride ($H_2NNH_2.2HCl$) (2 mg) to water (10 mL).

COMPARATIVE EXAMPLE C1

Preparation of Silver Nanowires

A 600 mL Parr reactor with a teflon liner, mixing means and a temperature control system was used. A combination prepared according to Example S4 was added to the reactor. The reactor was then sealed and purged with nitrogen. The combination in the reactor was then heated to 150° C. Then $1/5^{th}$ of a silver ion subcombination prepared according to Example S5 was charged to the reactor over 1 minute to form a creation mixture. The creation mixture was then mixed for ten minutes while maintaining the set point of the temperature controller at 150° C. Then over the following ten minutes, the set point of the temperature controller was linearly ramped down to 130° C. Then the remaining $4/5^{th}$ of the silver ion subcombination prepared according to Example S5 was charged to the reactor over ten minutes to form a growth mixture. The growth mixture was then mixed for twelve hours while maintaining the set point of the temperature controller at 130° C. to form a product mixture. The product mixture was then cooled down to room temperature. The reactor was then vented to relieve any pressure build up in the vessel and the product mixture was collected.

COMPARATIVE EXAMPLE C2

Preparation of Silver Nanowires

A 600 mL Parr reactor with a teflon liner, mixing means and a temperature control system was used. A reducing sugar subcombination prepared according to Example S6; a halide ion subcombination (2.1 mL) prepared according to Example S1; and a copper (II) ion subcombination (2.1 mL) prepared according to Example S2 were added to the reactor to form a combination. The reactor was then sealed and purged with nitrogen. The combination in the reactor was then heated to 130° C. Then a silver ion subcombination prepared according to Example S8 and a polyvinyl pyrrolidone (PVP) subcombination prepared according to Example S7 were charged to the reactor simultaneously, through separate lines, at a rate of 1 mL/min to form a growth mixture. The growth mixture was then mixed for eight hours while maintaining the set point of the temperature controller at 130° C. to form a product mixture. The product mixture was then cooled down to room temperature. The reactor was then vented to relieve any pressure build up in the vessel and the product mixture was collected.

EXAMPLES 1-6

Preparation of Silver Nanowires

A 600 mL Parr reactor with a teflon liner, mixing means and a temperature control system was used. A reducing sugar subcombination prepared according to Example S6; a halide ion subcombination (2.1 mL) prepared according to Example S1; and a copper (II) ion subcombination (2.1 mL) prepared according to Example S2 were added to the reactor to form a combination. The reactor was then sealed and purged with nitrogen. The combination in the reactor was then heated to 130° C. Then $1/5^{th}$ of a silver ion subcombination prepared according to Example S8 and $1/5^{th}$ of a polyvinyl pyrrolidone (PVP) subcombination prepared according to Example S7 were charged to the reactor simultaneously, through separate lines, at a rate of 1 mL/min. Then a reducing agent subcombination prepared according to the Example noted in TABLE 1 was added in the amount noted in TABLE 1 to the reactor. Then the remaining $4/5^{th}$ of the silver ion subcombination prepared according to Example S8 and $4/5^{th}$ of the polyvinyl pyrrolidone (PVP) subcombination prepared according to Example S7 were charged to the reactor simultaneously, through separate lines, at a rate of 1 mL/min to form a growth mixture. The growth mixture was then mixed for a hold time, as noted in TABLE 1, while maintaining the set point of the temperature controller at 130° C. to form a product mixture. The product mixture was then cooled down to room temperature. The reactor was then vented to relieve any pressure build up in the vessel and the product mixture was collected.

TABLE 1

| Ex. | Reducing agent (RA) subcombination | RA subcombination volume (mL) | Hold time (hrs) |
|---|---|---|---|
| 1 | S9 | 1.0 | 8 |
| 2 | S10 | 1.0 | 12 |
| 3 | S9 | 2.0 | 12 |
| 4 | S11 | 0.3 | 12 |
| 5 | S12 | 0.6 | 8 |
| 6 | S13 | 2.0 | 8 |

Recovered Silver Nanowire Analysis

Silver nanowires recovered from the product mixtures obtained from each of Comparative Examples C1-C2 and Examples 1-6 were then analyzed using an FEI Nova NanoSEM field emission gun scanning electron microscope (SEM) using FEI's Automated Image Acquisition (AIA) program. A drop of cleaned dispersion was taken from the UV/Vis cuvette and drop-cast onto a silica wafer coated SEM stub before being dried under vacuum. Backscatter electron images were collected using an FEI Nova NanoSEM field emission gun scanning electron microscope. FEI's Automated Image Acquisition (AIA) program was used to move the stage, focus, and collect images. Eighteen images of each sample were acquired at 6 μm horizontal field width. Semi-automated image analysis using ImageJ software categorized objects as wires versus particles based on an aspect ratio of 3. Wire widths were automatically measured as well as the total area of wires in the images. Particles were tabulated for individual size and total area of particles in the images. ImageJ software was also used to determine the silver nanowire diameter in TABLE 3. The average length of the silver nanowires was observed to exceed 20 μm, based on the SEM images obtained for the diameter analysis.

ImageJ software was used to analyze SEM images of the product silver nanowires from each of Comparative Examples C1-C2 and Example 1-6 to provide a relative measure of the silver nanoparticles having an aspect ratio of <3 in the product samples. The statistic used for this measure is the nanoparticle fraction, $NP_F$, determined according to the following expression:

$$NP_F = NP_A / T_A;$$

wherein $T_A$ is the total surface area of the substrate that is occluded by a given deposited sample of silver nanowires; and, $NP_A$ is the portion of the total occluded surface area that is attributable to silver nanoparticles having an aspect ratio of <3.

Spectral UV/Vis analysis of the product silver nanowires from each of Comparative Example C1-C2 and Examples 1-6 was performed using a Shimadzu UV 2401 Spectrophotometer. The raw UV/Vis absorbance spectra were normalized so that the local minimum near 320 nm and the local maximum near 375 nm span the range from 0 to 1. The wavelength of maximum absorbance, $\lambda_{max}$, and the normalized absorbance at 500 nm, $Abs_{500}$, are reported in TABLE 2.

TABLE 2

| | Silver Nanowire Diameter (nm) | | | | Spectral Analysis | |
|---|---|---|---|---|---|---|
| Ex. | Median | Mean | Standard Deviation | $NP_F$ | $\lambda_{max}$ (nm) | $Abs_{500}$ |
| C1 | 41.4 | 59.4 | 49.0 | 0.54 | 378 | 0.77 |
| C2 | 33.8 | 44.7 | 37.6 | 0.29 | 378 | 0.47 |
| 1 | 27.1 | 29.9 | 10.0 | 0.28 | 372 | 0.45 |
| 2 | 26.7 | 31.5 | 17.5 | 0.36 | 372 | 0.41 |
| 3 | 27.4 | 31.0 | 12.6 | 0.23 | 373 | 0.33 |
| 4 | 26.3 | 27.4 | 8.0 | 0.19 | 373 | 0.26 |
| 5 | 34.4 | 43.1 | 30.3 | 0.45 | 377 | 0.54 |
| 6 | 37.9 | 45.9 | 27.2 | 0.32 | 376 | 0.34 |

We claim:

1. A method for manufacturing high aspect ratio silver nanowires, comprising:

providing a container;

providing water;

providing a reducing sugar;

providing a reducing agent;

providing a polyvinyl pyrrolidone (PVP), wherein the polyvinyl pyrrolidone (PVP) provided is divided into a first part of the polyvinyl pyrrolidone (PVP) and a second part of the polyvinyl pyrrolidone (PVP);

providing a source of copper (II) ions;

providing a source of halide ions;

providing a source of silver ions, wherein the source of silver ions provided is divided into a first portion of the source of silver ions and a second portion of the source of silver ions;

adding the water, the reducing sugar, the source of copper (II) ions and the source of halide ions to the container to form a combination;

heating the combination to 110 to 160 ° C.;

adding the first part of the polyvinyl pyrrolidone (PVP), the first portion of the source of silver ions and the reducing agent to the combination in the container to form a creation mixture;

then adding to the container the second part of the polyvinyl pyrrolidone (PVP) and the second portion of the source of silver ions to form a growth mixture;

maintaining the growth mixture at 110 to 160 ° C. for a hold period of 2 to 30 hours to provide a product mixture; and, recovering a plurality of high aspect ratio silver nanowires from the product mixture;

wherein a total glycol concentration in the container is <0.001 wt % at all times.

2. The method of claim 1, wherein the first part of the polyvinyl pyrrolidone (PVP) and the first portion of the source of silver ions are added to the container simultaneously.

3. The method of claim 1, wherein the first portion of the source of silver ions is added to the combination below a surface of the combination in the container.

4. The method of claim 1, further comprising:

a delay period, wherein the delay period is interposed between adding the first portion of the source of silver ions to form the creation mixture and adding the second portion of the source of silver ions to form the growth mixture.

5. The method of claim 4, wherein the first part of the polyvinyl pyrrolidone (PVP) is 10 to 40 wt % of the polyvinyl pyrrolidone (PVP) provided; and, wherein the first portion of the source of silver ions is 10 to 40 wt % of the source of silver ions provided.

6. The method of claim 1, wherein the reducing agent is selected from ascorbic acid; borohydride salts; hydrazine; salts of hydrazine; hydroquinone; $C_{1-5}$ alkyl aldehyde and benzaldehyde.

7. The method of claim 1, wherein the reducing sugar provided is glucose; and, wherein the reducing agent provided is at least one of ascorbic acid and sodium borohydride.

8. The method of claim 1, further comprising:

providing a pH adjusting agent; and, adding the pH adjusting agent to the combination, wherein the combination has a pH of 2.0 to 4.0 following addition of the pH adjusting agent.

9. The method of claim 1, further comprising:

purging a container vapor space in contact with the combination in the container to provide a reduced oxygen gas concentration in the container vapor space, wherein the reduced oxygen gas concentration in the container vapor space is less than or equal to 2000 ppm;

sparging the source of silver ions provided with an inert gas to extract entrained oxygen gas from the source of silver ions provided and to provide a low oxygen gas concentration in a silver ion vapor space in contact with the source of silver ions provided, wherein the low oxygen gas concentration in the silver ion vapor space is less than or equal to 10,000 ppm;

purging a PVP vapor space in contact with the polyvinyl pyrrolidone (PVP) provided to provide a diluted oxygen gas concentration in the PVP vapor space, wherein the diluted oxygen gas concentration in the PVP vapor space is less than or equal to 10,000 ppm;

maintaining the low oxygen gas concentration in the silver ion vapor space and the diluted oxygen gas concentration in the PVP vapor space; and, maintaining the reduced oxygen gas concentration in the container vapor space during formation of the creation mixture, during formation of the growth mixture and during the hold period.

10. The method of claim 1, wherein the reducing sugar provided is glucose;

wherein the reducing agent provided is selected from ascorbic acid; borohydride salts; hydrazine; salts of hydrazine; hydroquinone; $C_{1-5}$ alkyl aldehyde and benzaldehyde;

wherein the polyvinyl pyrrolidone (PVP) provided has a weight average molecular weight, $M_W$, of 40,000 to 150,000 Daltons;

wherein the source of copper (II) ions provided is copper (II) chloride;

wherein the source of halide ions provided is sodium chloride;

wherein the source of silver ions provided is silver nitrate;

wherein the first part of the polyvinyl pyrrolidone (PVP) is 10 to 40 wt % of the polyvinyl pyrrolidone (PVP) provided; and, wherein the first portion of the source of silver ions is 10 to 40 wt % of the source of silver ions provided.

* * * * *